US005842793A

United States Patent [19]

Katayama et al.

[11] Patent Number: 5,842,793

[45] Date of Patent: Dec. 1, 1998

[54] PRINTING DEVICE

[75] Inventors: Yoshiki Katayama, Nagoya; Masatoshi Kokubo, Aichi-ken; Naohisa Kinoshita, Nagoya, all of Japan

[73] Assignee: Brother Kogyo Kabushiki Kaisha, Nagoya, Japan

[21] Appl. No.: 844,067

[22] Filed: Apr. 18, 1997

[30] Foreign Application Priority Data

Apr. 22, 1996 [JP] Japan ..... 8-100353
Apr. 22, 1996 [JP] Japan ..... 8-100355

[51] Int. Cl.[6] ..... B41J 3/36

[52] U.S. Cl. ..... 400/88; 400/61

[58] Field of Search ..... 400/61, 88, 615.2; 358/473; 382/313

[56] References Cited

U.S. PATENT DOCUMENTS

| | | | |
|---|---|---|---|
| 4,947,262 | 8/1990 | Yajima et al. | 400/88 |
| 5,344,247 | 9/1994 | Sakuragi et al. | 400/61 |
| 5,551,785 | 9/1996 | Mori et al. | 400/615.2 |
| 5,593,236 | 1/1997 | Bobry | 400/88 |

*Primary Examiner*—John Hilten
*Attorney, Agent, or Firm*—Mc Ginn & Gibb, P.C.

[57] ABSTRACT

A print device including: a storage unit which stores image data for an image to be printed; a print unit which prints the image on a recording medium based on the image data stored in the storage unit; a print region setting unit which sets, with respect to the recording medium, a print region within which the image is to be printed; and a processing unit which processes the image data so that the image is printable within the print region by the print unit.

22 Claims, 9 Drawing Sheets

FIG. 5
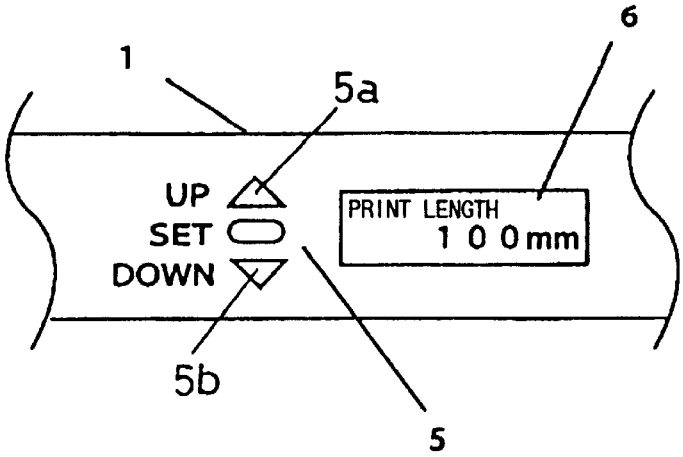
FIG. 6 (a)
PRINT LENGTH OF PRINT DATA, AS STORED IN MEMORY PORTION
A B C D E F G H I J K L M N
FIG. 6 (b)
PRINT DATA (PRINTED AFTER REDUCTION PROCESS)
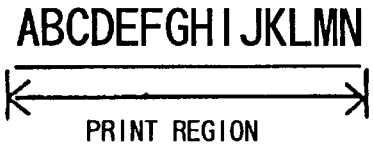
FIG. 6 (c)
PRINT DATA (PRINTED AFTER DIVISION PROCESS)
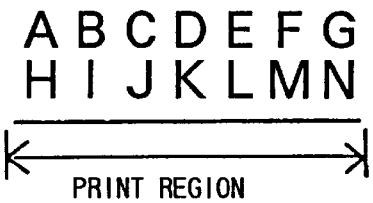

PRINTING DEVICE

BACKGROUND OF THE INVENTION

1. Field of the Invention

The present invention relates to a printing device wherein printing is performed by manually, automatically, or semi-automatically scanning the device across the surface of a recording medium.

2. Description of the Related Art

Conventionally, there have been known scanning printing devices wherein printing is performed by scanning the devices across the surface of a recording medium. Unlike a fixed printing device, scanning printing devices can perform printing not only on flat sheets, but also on three-dimensional objects. Therefore the scanning printing device is capable of printing on a wide range of objects, and so is very handy.

British Patent Specification 1 366 253, which is hereby incorporated by reference, describes a conventional manual printing device with a displacement detection unit for detecting relative positional change between a print head and a recording medium in order to determine the scanning speed of the manual printing device across the recording medium. The detection unit includes a roller which moves across the surface of the recording medium at the same speed as the print head. The roller rotates in contact with the surface of the recording medium. Therefore, by detecting rotational angle of the roller, the detection unit can determine relative positional change between the print head and the recording medium, and consequently the position of the print head.

In this way, even when the scanning speed is not uniform, the printing device of British Patent Specification 1 366 253 can perform excellent printing by simultaneously detecting relative positional change between the print head and the recording medium using the displacement detection unit and controlling the print head based on the detected results. Further, the printing device of British Patent Specification 1 366 253 can easily print on any position of the recording medium and can print on a variety of recording media, such as on thick prebound books or documents, or large-sized sheets.

Because the printing device of British Patent Specification 1 366 253 can print starting from any position on a recording medium, the user needs to know the length of printed characters or will overrun a desired print region because he or she misjudged the length required for printing the image on the recording medium. Therefore, when printing must be performed within a limited region, such as a frame preprinted on a sheet or a label, the user may need to perform several test printings on a separate sheet of paper before he or she can get a grasp of how the printing device needs to be positioned and scanned to fit the image in the desired region. Time required for operations before printing is therefore undesirably increased.

Japanese Laid-Open Patent Application No. HEI-3-67671, which is hereby incorporated by reference, describes a printing device having a partially transparent printing position display means. The display means displays an image to be printed with spacing and size in which the image will actually be printed. The display means is placed over the print region of the print medium to be printed with the images. Because the display means is partially transparent, the user can view the print region overlapped with the images to be printed. When patterns, such as lines or frames, are preprinted on the print medium, the user can confirm whether the images will undesirably overlap the preprinted patterns when printed on the print medium. If so, the user can make adjustments until the image will be printed in regions indicated by the preprinted patterns.

With the conventional printing device of Japanese Laid-Open Patent Application No. HEI-3-67671, when an image is inputted by an input mechanism, all the inputted image is printed in accordance with scanning movement of the printing device across the print medium.

SUMMARY OF THE INVENTION

It is conceivable that the size of the image to be printed can be adjusted until the image can fit in the desired print region before actually printing on the desired recording medium. However, these added conceivable operations would make printing extremely troublesome. Further, when a relatively large image is to be printed in a relatively small print region, the image must be reduced at a high reduction rate. In this case, even though the image will be able to fit in the desired print region, it might be illegible because the characters are too small to read.

Although the printing device of Japanese Laid-Open Patent Application No. HEI-3-67671 enables the user to view both the length of the characters and the preprinted patterns on the printing medium, so the user can print without first knowing the length of the printable region, the printing device has a complicated configuration and is therefore costly.

Further, with the conventional printing device of Japanese Laid-Open Patent Application No. HEI-3-67671, once an image is inputted, the entire image has to be printed so that when the user desires to print only a portion of the image, he or she has to newly input the image.

It is an objective of the present invention to overcome the above-described problems and to provide a printing device capable of printing print data within a desired print region of a recording medium and also to provide a scanning printing device capable of notifying the user of the length of print image in a scanning direction by scanning the device without printing the image.

In order to achieve the above-described objectives, a print device according to the present invention includes: a storage unit which stores image data for an image to be printed; a print unit which prints the image on a recording medium based on the image data stored in the storage unit; a print region setting unit which sets, with respect to the recording medium, a print region within which the image is to be printed; and a processing unit which processes the image data so that the image is printable within the print region by the print unit.

With this configuration, even when a print region is limited to a specific region, a user can easily perform printing as he or she desires.

According to another aspect of the present invention, the processing unit can perform at least two processes on the image in order to fit the image in the desired printing range. Also, a selection unit is provided to select an appropriate one of the two processes. With this configuration, a user can select a desired process from among the processes and so can easily print easy to read characters in a limited print region.

According to another aspect of the present invention, the processing unit is capable of reducing the size of the image so that the image fits into the desired print region. With this configuration, even when the print region setting unit selects a rather small print region for printing image data stored in the memory unit, the printed image can fit in the selected print region.

According to still another aspect of the present invention, the processing unit divides the image so that the image fits into the desired print region. With this configuration, the printed image , such as characters, can fit in the selected print region while maintaining the image in an appropriate size that is not excessively reduced.

According to another aspect of the invention, a print device for printing images by being scanned across a recording medium includes: a storage unit which stores image data for an image; a print unit which prints the image data stored in the storage unit; a setting unit capable of setting a non-print mode for preventing printing of the image data stored in the storage unit; and a notification unit which, when the setting unit sets the non-print mode, notifies completion of scanning of the device in a distance equal to a length of the image. With this configuration, a user can know the length of the region in which an inputted image is to be printed.

According to another aspect of the present invention, a print device for printing images by being scanned across a recording medium includes: an input unit by which image data for an image is inputted; a movement detection unit which detects scanning movement of the print device across the recording medium; a retrieval unit which serially retrieves, in correspondence with detection by the movement detection unit, the image data inputted by the input means; a print unit which prints the image data retrieved by the retrieval unit; and a setting unit capable of selectively setting a print mode for using the print unit to print according to the image data retrieved by the retrieval unit and a non-print mode for preventing printing of the data retrieved by the print unit. With this configuration, when the non-printing mode is selected for unnecessary portions of an image, printing is prohibited for the portions.

BRIEF DESCRIPTION OF THE DRAWINGS

The above and other objects, features and advantages of the invention will become more apparent from reading the following description of the preferred embodiment taken in connection with the accompanying drawings in which:

FIG. 5 is a magnified view showing a print region setting switch and a display portion of the printing device;

FIG. 6(*a*) shows print length of print data as stored in a memory portion of the printing device;

FIG. 6(*b*) shows the print data of FIG. 6(*a*) printed after being subjected to a reduction process;

FIG. 6(*c*) shows the print data of FIG. 6(*a*) printed after being subjected to a division process;

DETAILED DESCRIPTION OF THE PREFERRED EMBODIMENTS

Figure 1:
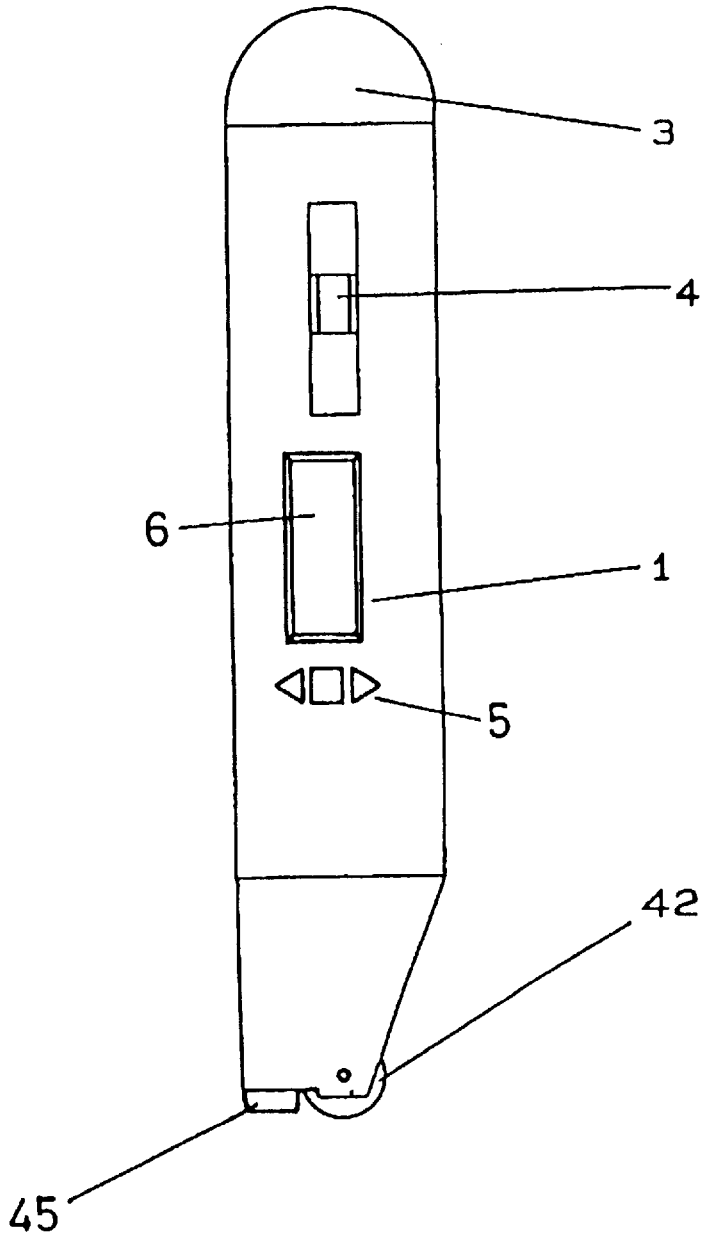
FIG. 1 is a side view showing a printing device according to a first embodiment of the present invention.

A printing device according to preferred embodiments of the present invention will be described while referring to the accompanying drawings wherein like parts and components are designated by the same reference numerals to avoid duplicating description.

First, a printing device according to a first preferred embodiment of the present invention will be provided while referring to FIGS. 1 through 8. FIG. 1 is a perspective view showing a printing device according to a first embodiment of the present invention. A body 1 of the present printing device is formed into a cylindrical shape so as to be easily held by a user. A roller 42 is rotatably disposed at a lower tip of the body 1. The surface of the roller 42 is covered with a resilient material such as rubber. An ink-jet print head 45 is disposed at the lower tip of the body to one side of the roller 42. An interface portion 3 used for infrared transmission of print data to and from an external device, such as a personal computer (not shown in the drawings), is provided at the upper tip of the body 1. Also, several components are provided on the side of the body 1, such as: a mode switching switch 4 for switching operation modes of the printing device between a data input mode and a print mode; a print region setting switch 5 for setting the length of the print region on a recording medium such as a print sheet; and a display portion 6 for confirming the setting condition of the print region. It should be noted that the mode switching switch 5 also serves as a power source switch for turning ON and OFF the printing device.

The printing device of the present embodiment is for printing print data inputted from an external device, such as a personal computer, onto a recording medium, such as paper. To perform printing, a user grasps the body 1 and brings the roller 42 into contact with the recording medium. The user scans the device across the printing medium while contacting and rotating the roller 42 over the printing medium.

Figure 2:
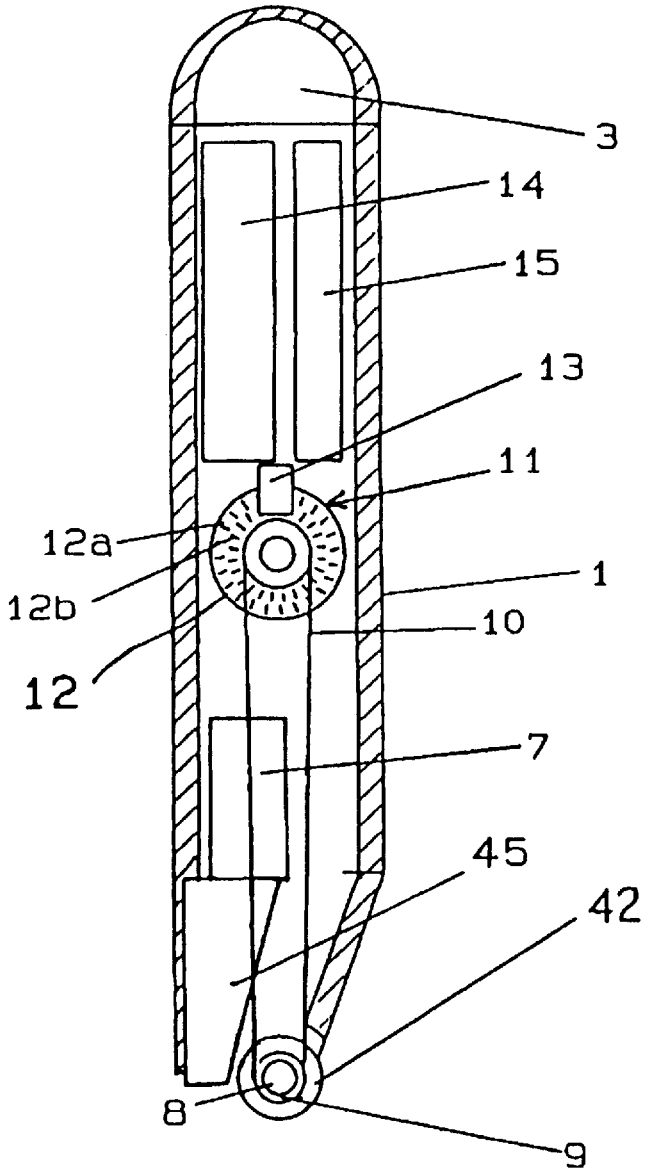
FIG. 2 is a cross-sectional view showing internal configuration of the printing device.

FIG. 2 is a cross-sectional view showing internal configuration of the printing device according to the present embodiment. The internal configuration of the printing device according to the present embodiment will be explained in detail while referring FIG. 2.

The roller 42 is disposed at the lower tip of the body 1 so as to be freely rotatable around a shaft 8. The ink-jet print head 45 is disposed at one side of the roller 42. The roller 42 maintains a fixed distance between the tip of the print head 45 and the recording medium.

An ink tank 7 for supplying ink to the ink-jet print head 45 is provided above the ink-jet print head 45. A pulley 9 is fixed to the shaft 8 of the roller 42 so as to rotate in association with rotation of the front roller 42. A belt 10 is suspended between the pulley 9 and a rotation disk 12 of an encoder 11, to be described later, so that rotational force generated by the pulley 9 in association with rotation of the front roller 42 is transmitted to the rotation disk 12 of the encoder 11. Slits 12*a*, 12*b* are formed in the periphery of the rotation disk 12 at predetermined intervals. The slits 12*b* are formed with a phase shift of 90° with respect to the slits 12*a*. A photointerrupter 13 is provided to the encoder 11. The photointerrupter 13 is turned ON and OFF by rotation of the slits 12*a*, 12*b* and converts rotational speed of the rotation disk 12 into electric pulse signals accordingly. The converted electric pulse signals are inputted to a control portion 14 provided in the body 1.

The control portion 14 is for receiving electric pulse signals outputted from the ink-jet print head 45 and the photointerrupter 13, and for controlling the interface portion 3. A power source 15 for supplying power to various components of the printing device is provided near the control portion 14. The power source 15 is configured from a power supplying portion, such as a small primary or secondary battery, and components for stabilizing power.

Next, an explanation will be provided for a detection method used by the encoder 11 to detect rotational amount and direction of the roller 42 when the printing device of the present embodiment is scanned.

Figure 3:
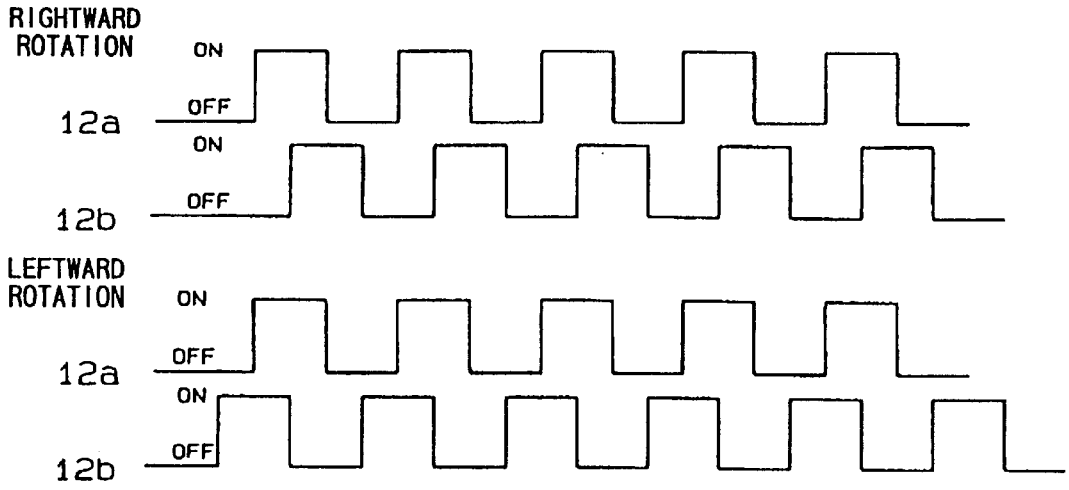
FIG. 3 is a timing chart showing processes for detecting movement amount and direction of the printing device.

The roller 42 rotates when a user scans the printing device on the recording medium. FIG. 3 shows the waveforms of signals outputted from the photointerrupter 13 when the roller 42 rotates in a rightward direction and in a leftward direction. When the roller 42 rotates in the rightward direction, the slit 12*b* produces a detection waveform having a phase shifted 90° behind the detection waveform produced by the slit 12*a*. When the roller 42 rotates in the leftward direction, the slit 12*b* produces a detection waveform having a phase shifted 90° ahead of the detection waveform produced by the slit 12*a*. Therefore, rotational direction of the roller 42 can be detected by detecting phase shift between the two waveforms. Further, movement amount of the printing device can be determined by calculating the number of pulses of the detection waveforms from the photointerrupter 13. By driving the ink-jet print head 45 based on the detection signal from the photointerrupter 13, the printing device of the present embodiment can constantly perform normal printing regardless of the movement speed of the device across the recording medium.

Figure 4:
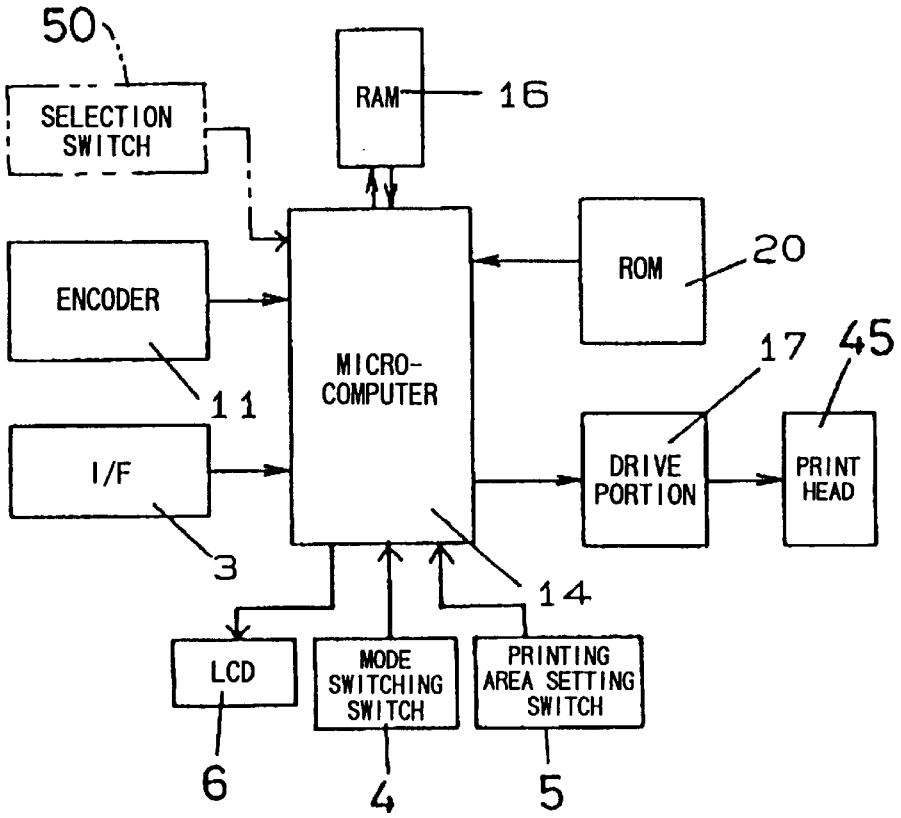
FIG. 4 is a block diagram showing electrical components of the printing device.

FIG. 4 is a block diagram showing electrical configuration of the printing device according to the present embodiment. As shown in FIG. 4, a control portion such as a microcomputer is connected to: a memory device 20 such as a ROM storing control programs for controlling each electrical component based on a predetermined program; a memory portion 16 such as a RAM for storing print data inputted from the interface portion 3; and a drive portion 17 for driving the ink-jet print head 45. The interface portion 3, the mode switching switch 4, the print region setting switch 5, and the display 6 are also connected to the control portion 14. Electric pulse signals based on the rotational speed of the encoder 11 are inputted to the control portion 14. Each electrical component is included in the body 1 of the manual-scanning type printing device shown in FIG. 1.

Next, print region setting operations of the printing device according to the present embodiment will be explained while referring FIG. 5. FIG. 5 is a magnified view showing the print region setting switch 5 and the display portion 6 provided to the body 1.

First, print data inputted from an external device via the interface portion 3 is stored in the memory portion 16. At the same time, a print length indicating the length at which the print data will be printed is displayed on the display portion 6. In this way, a user can know the length required to print the print data he or she desires to print. In order to designate desired length of the print region on the recording medium, the user presses an UP/DOWN switch 5*a*, 5*b* to input a length desired for the print region. The inputted length of the print region is temporarily stored in the memory portion 16, or in a register in the control portion 14. For example, when the user desires to set the print region to 50 mm when the display portion 6 shows 100 mm as shown in FIG. 5, the user presses the DOWN switch 5*b* until the print length displayed on the display portion 6 reaches 50 mm.

Figure 7:
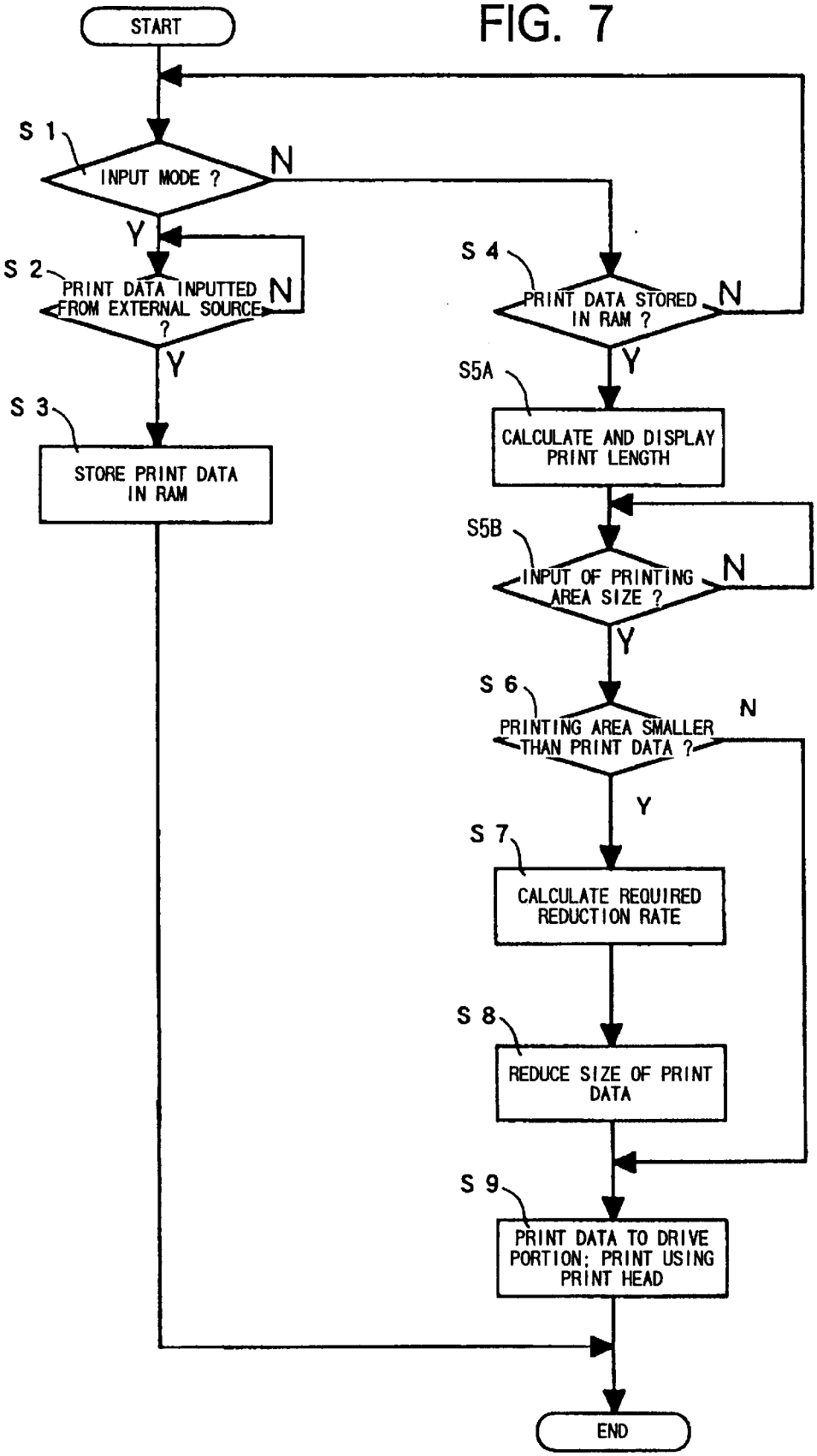
FIG. 7 is a flowchart showing printing control operations of the printing device.
Figure 8:
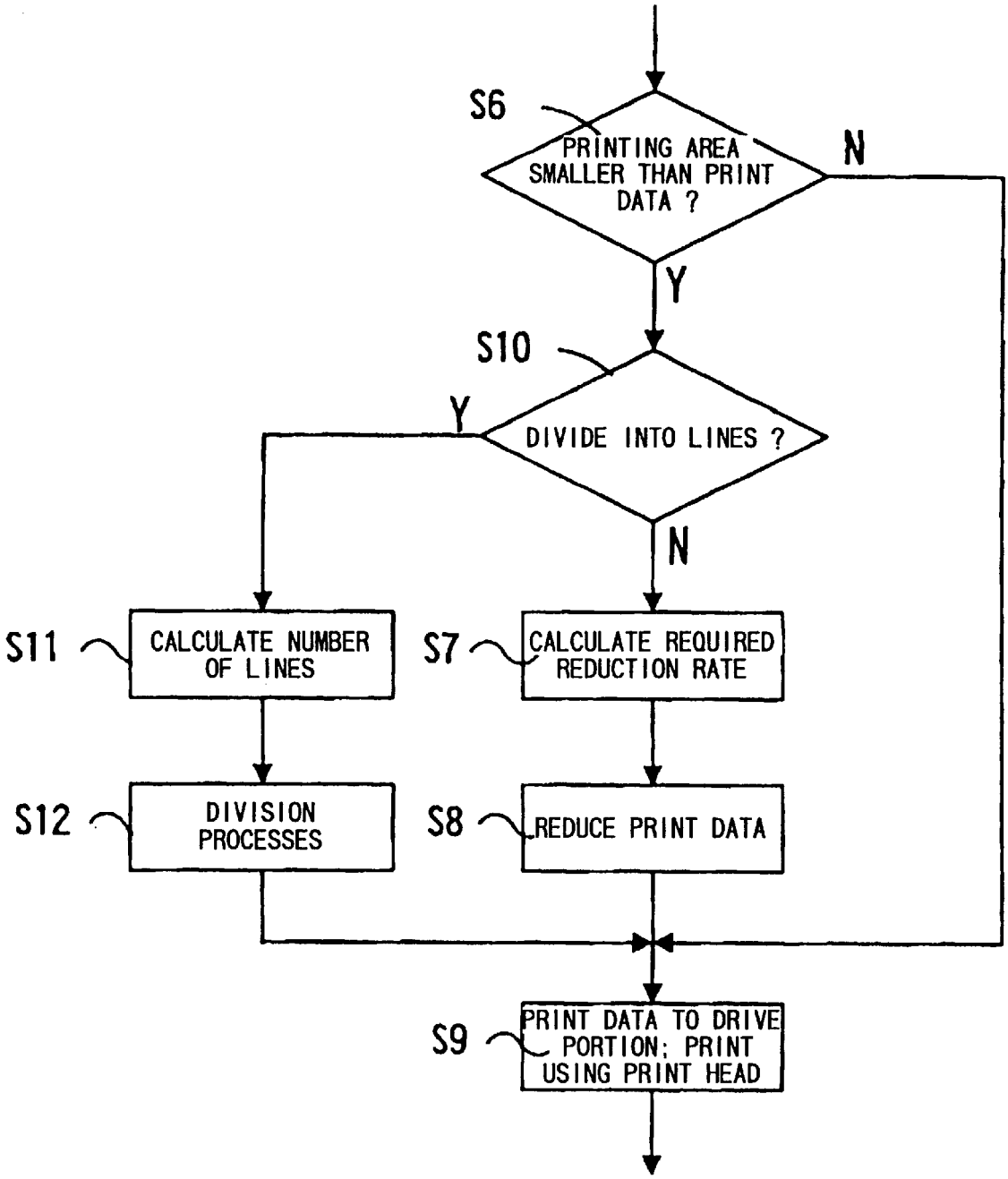
FIG. 8 is a flowchart showing printing control operations of a printing device according to a modification of the first embodiment of the present invention.

While referring to the flowchart of FIG. 7, an explanation will be provided for operations of the printing device of the first embodiment having the above-described configuration.

The printing device according to the present embodiment operates based on predetermined programs stored in the memory device 20. First, whether or not the switch 4 is set to an input mode is determined in SI. If so (S1:YES), then in S2 the control portion 14 awaits print data to be inputted to the interface portion 3 from an external device, such as a personal computer, using infrared signals. When the control portion 14 detects input of the print data (S2:YES), then in S3 the print data is temporarily stored in the memory portion 16. Before the print data inputted from the external device is stored in the memory portion 16, it is desirable to convert the print data into a format easily used by the control portion 14 to print using the ink-jet print head 45. By converting the print data before storing it in the memory portion 16, the burden placed on the control portion 14 during a print mode, to be described later, can be lightened.

Next, when the user uses the switch 4 to select the print mode (S1:NO), then in S4 the control portion 14 determines whether or not print data is already stored in the memory portion 16. If the control portion 14 determines that print data is stored in the memory portion 16 (S4:YES), then in S5A the control portion 14 calculates the length at which the print data will be printed, referred to as the print length hereinafter, and displays the print length on the display portion 6. Then in S5B the control portion 14 waits for the user to operate the print region setting switch 5 to input the length of the desired print region.

When the user inputs the length of the print region (S5B:YES), then in S6 the control portion 14 compares the inputted length of the print region with the print length of the print data stored in the memory portion 16. When the print length of the print data is smaller than the print region (S6:NO), then in S9, the control portion 14 transmits the print data to the drive portion 17 and the drive portion 17 drives the ink-jet print head 45 to perform printing.

On the other hand, when the print length of the print data is greater than the print region (S6:YES), then in S7 the control portion 14 calculates a reduction rate required to reduce the print length so that the print data can be printed within the print region. In S8, the control portion 14 processes the print data to reduce the print length based on the reduction rate calculated in S7. Finally, in S9, the control portion 14 transmits the print data to the drive portion 17 to perform printing using the ink-jet print head 45.

Next, an illusory example will be provided while referring to FIGS. 6(*a*) and 6(*b*). When the print length stored in the memory portion 16 is 100 mm as shown in FIG. 6(*a*) and, in S5, the user sets the length of the print region to 50 mm, then the control portion 14 performs reduction processes on the image data stored in the memory portion 16 to reduce the print length in half so that the resultant printed image will fit within the 50 mm print region as shown in FIG. 6(*b*). The control portion 14 then prints the image data. In this way, the user can easily print the print data within the print region by merely setting the length of a desired print region.

In the above-described embodiment, when the print data does not fit within a selected print region, the control portion 14 performed processes to reduce the print length. However, in a modification of the first embodiment, the control portion divides the print data into a plurality of lines. A printing device according to the modification of the first embodiment will be explained while referring to FIG. 8. It should be noted that drawings and explanations for steps in the modification the same as steps shown in FIG. 7 will be omitted.

First, when the control portion 14 determines that the print length of the print data is greater than the inputted length of the print region (S6:YES), then in S10 the control portion 14 displays optional processes on the display portion 6 and waits for the user to select either the reduction process described above or a division process. When the user manipulates the selection switch 50 shown in FIG. 4 to select the division process (S10:YES), then in Sll the control portion 14 calculates the number of lines into which the print data must be divided so that the print data will fit within the print region. In S12, the control portion 14 divides the print data stored in the memory 16 based on the number of lines determined in Sll. Finally, in S9 the control portion 14 transmits the data to the drive portion 17 for performing printing using the ink-jet print head 45. In this way, by dividing the print data into a plurality of lines, characters can be printed in an appropriate size even when the print region is small.

Next, a printing device according to a second embodiment of the present invention will be provided while referring to FIGS. 9 through 12. The printing device of the second embodiment is capable of measuring the length of a desired print region before printing to determine if the print data will fit in the printable region.

The printing device according to the second embodiment includes a scanning printing portion 120 for printing by being scanned across a recording medium such as paper; and an input portion 170 provided separate from the scanning printing portion and used for inputting print data.

Figure 9:
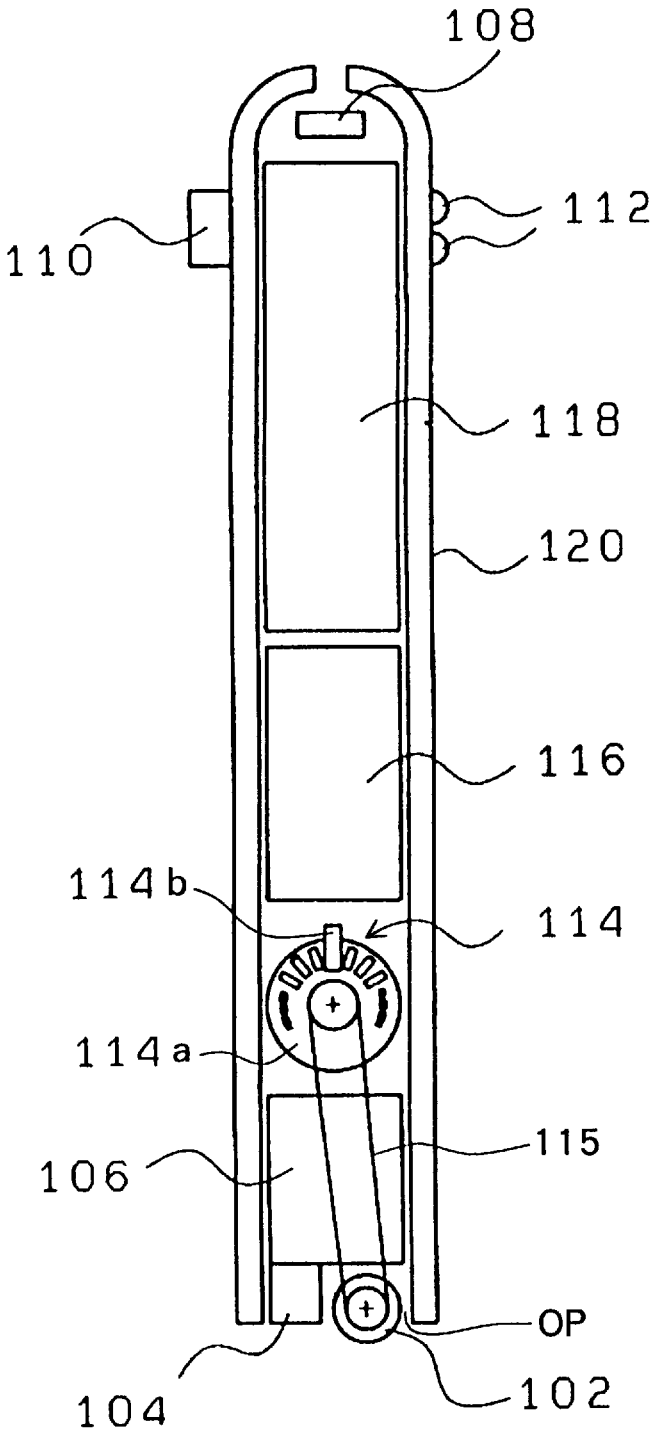
FIG. 9 is a side view showing internal configuration of a scanning printing portion of a scanning printing device according to a second embodiment of the present invention.

First, an explanation of internal configuration of the scanning printing portion 120 will be provided while referring to FIG. 9. An opening portion OP is formed to the under surface of the scanning printing portion 120. A rotatable roller 102 protruding downward is provided in the opening portion OP. When the scanning printing portion 120 moves, the roller 102 rotates while in contact with a recording medium. An ink-jet print head 104 is disposed next to and in parallel with the roller 102 in the opening portion OP. A line of nozzle are formed in the ink-jet print head 104 so as to extend in parallel with the rotational axis of the roller 102. Also, a non-printing mode selection switch 110 and an infrared transmission portion 112 are provided at side portions of the scanning printing portion 120. A piezoelectric buzzer 108 is provided to the upper portion of the scanning printing portion 120.

A rotary encoder 114 is connected to rotate in association with the roller 102. The rotary encoder 114 includes a slit disk 114*a* and a photointerrupter 114*b* for optically detecting slits of the slit disk 114*a*. A belt 115 links the slit disk 114*a* and the roller 102 so that the slit disk 114*a* rotates in association with the roller 102. With this configuration, the photointerrupter 114*b* outputs one pulse each time the roller 102 rotates a predetermined rotational angle.

The scanning printing portion 120 further includes: an ink tank 106 for supplying ink to the ink-jet print head 104; a battery 116 for supplying power to the scanning printing portion 120; and a circuit board 118 mounted with a CPU 140, for example, to be described later.

Figure 10:
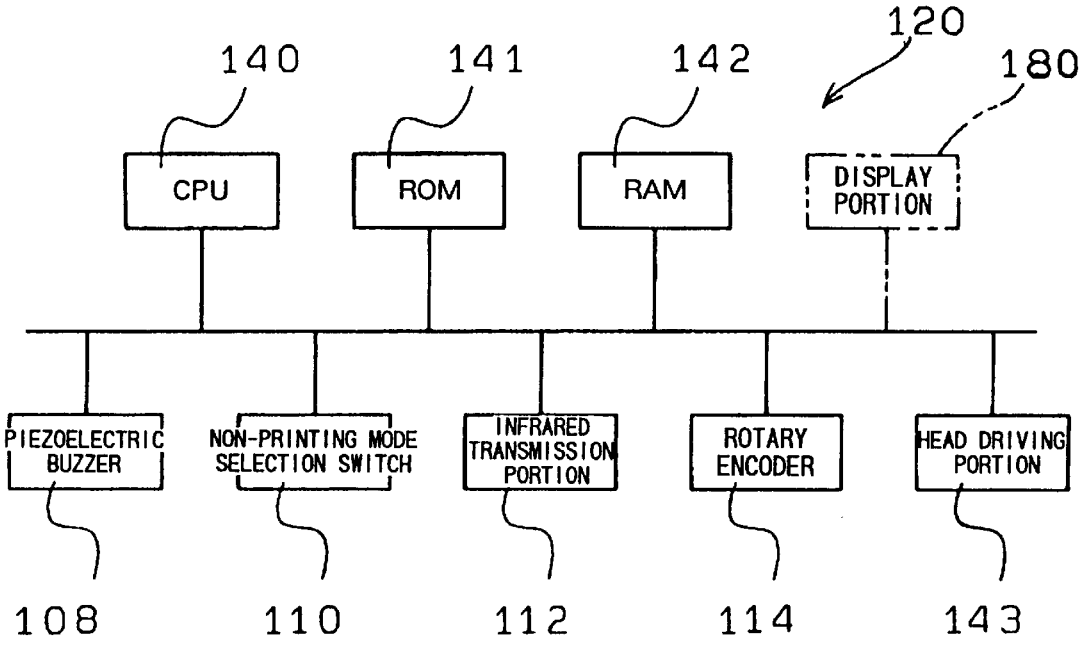
FIG. 10 is a block diagram showing electrical configuration of the scanning printing portion according to the second embodiment.

Next, an explanation for electrical configuration of the scanning printing portion 120 will be provided while referring FIG. 10. The CPU 140 controls overall operations of the scanning printing portion 120 and executes various types of calculation processes. The CPU 140 is connected to a ROM 141, a RAM 142, the rotary encoder 114, the infrared transmission portion 112, the piezoelectric buzzer 108, the non-printing mode selection switch 110, and a head driving portion 143 for driving the ink-jet print head 104.

The ROM 141 stores various programs for regulating operations of the scanning printing portion 120. The RAM 142 is formed with storage regions, such as a region storing print data and a calculation region used during calculation processes.

Figure 11:
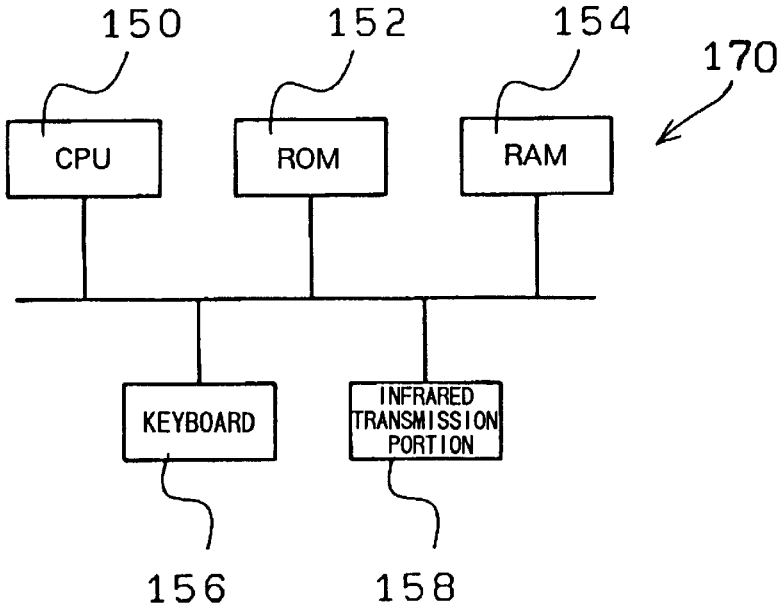
FIG. 11 is a block diagram showing electrical configuration of a character data input portion of the scanning printing device according to the second embodiment.

Next, an explanation for electrical configuration of the input portion 170 will be provided while referring FIG. 11.

A CPU 150 is provided for performing overall control of the input portion 170 and for executing various calculation processes. The CPU 150 is connected to a ROM 152, a RAM 154, a keyboard 156, and an infrared transmission portion 158. Also, the ROM 152 stores a plurality of different sized character-shape data (i.e., dot pattern data) and a character size table, as well as a variety of programs for regulating operations relating to input of character data using the keyboard 156. The character size table stores the addresses of the different types of character shape data in correspondence with corresponding character data font and character size.

The keyboard 156 is used for inputting characters and symbols to be printed. The RAM 154 is provided with regions for storing data, such as data for characters inputted from the keyboard 156. The infrared transmission portion 158 interactively transmits various data, including print data, between the scanning printing portion 120 and the input portion 170 in cooperation with the infrared transmission portion 112 of the scanning printing portion 120.

All components of the input portion 170 are provided in a device, such as a personal computer, provided separately from the scanning printing portion 120.

Figure 12:
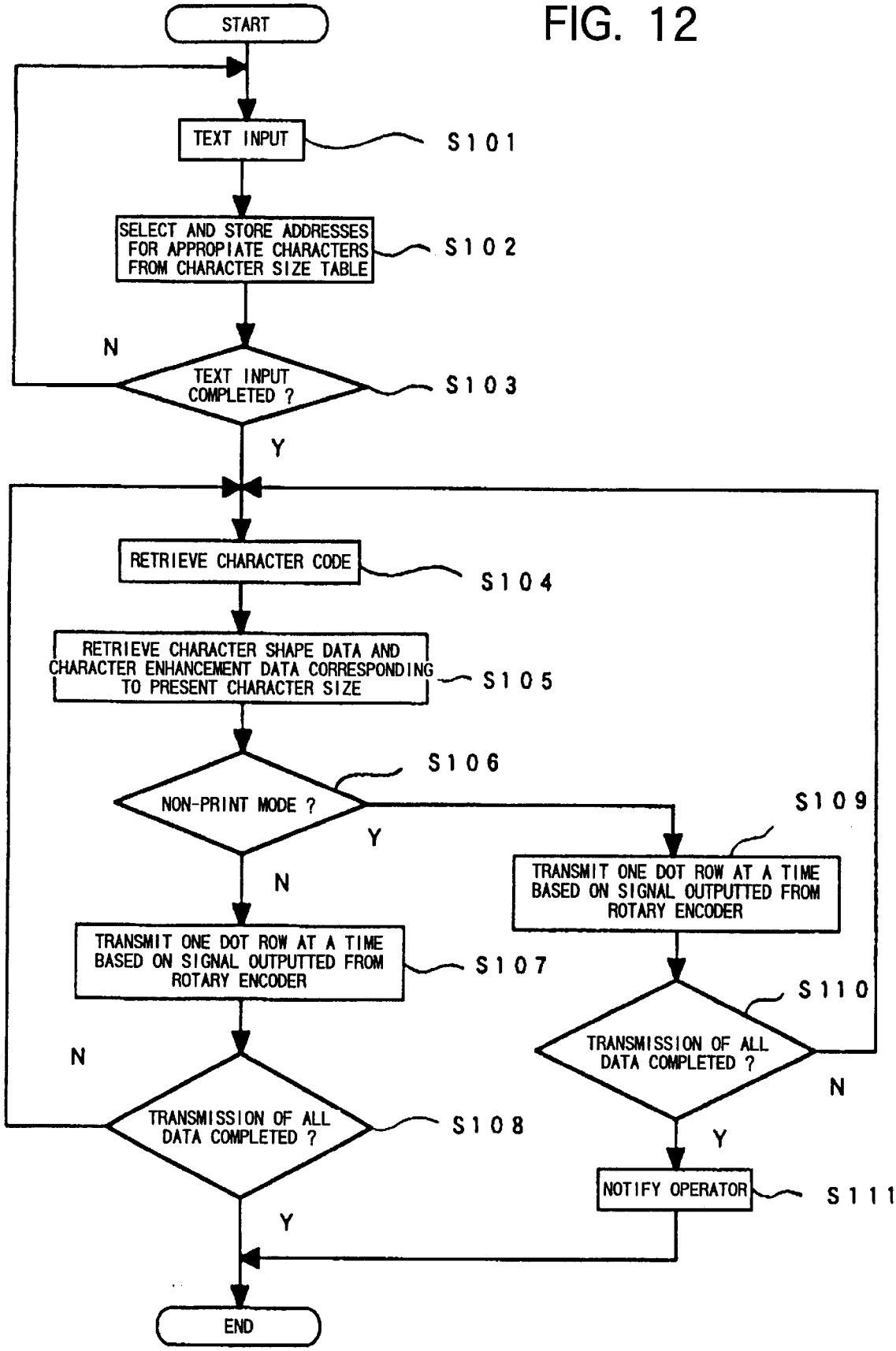
FIG. 12 is a flowchart showing printing processes of the scanning printing device according to the second embodiment.

Next, operations of the printing device of the second embodiment will be explained while referring to the flowchart in FIG. 12. First in S101, a user uses the keyboard 56 of the input portion 170 to input a character he or she desires to print, as well as the font and size of the character. Then in S102, an address for the character in the corresponding font and size is read from the character size table in the ROM 152 and is stored in the RAM 154.

Next, whether or not input of characters is completed is determined in S103. If not, (S103:NO), then S101 and S102 are repeated until input of characters is completed (S103:YES).

Next in S104, the CPU 150 reads character code data, corresponding to the subject characters, from its storage region is the RAM 154. In S105, character-formed data (dot pattern data) corresponding to the character code data read in S104 is read from the ROM 152 based on the address information stored in the RAM 154 for the characters to be printed.

Next, in S106, it is determined whether or not the non-printing mode selection switch 110 has been used to select a non-printing mode. When a print mode has been selected (S106:NO), then, when the user scans the scanning printing portion 120, in S107 one dot line's worth of print data is transmitted, based on pulse signals generated by rotation of the rotary encoder 114, to the head drive portion 143 using the infrared transmission portion 112 and the infrared transmission portion 158. The ink-jet print head 14 prints the characters and the like accordingly. Next, in S108 the CPU 150 determines whether or not character code data for unprinted characters remains in the RAM 154. If character code data remains (S108:NO), then the corresponding characters are printed by repeating processes in S104 to S108.

Next, an explanation will be provided for when the user selects the non-printing mode. When the user wants to confirm whether or not inputted characters can fit within a predetermined region of a recording medium he or she desires to print on, the user selects the non-printing mode by using the non-printing mode selection switch 110, which results in a positive determination is S106. The user then scans the scanning printing portion 120 across the predetermined region starting from one end of the region. In S109, one dot line's worth of print data is transmitted by using the infrared transmission portion 112 and the infrared transmission portion 58 based on pulse signals generated by rotation of the rotary encoder 114. However, in S109, the print data is not outputted to the head drive portion 143 so that the ink-jet print head 104 does not perform printing. Next in S110, in a manner similar to S108, the CPU 150 determines whether or not character code data for unprinted characters remains in the RAM 154. When character code data remains (S110:NO), then processes in S104 to S106, and S109 are repeated. After all character code data has been transmitted (S10:YES), then in S111, the CPU 150 transmits a notification signal to the piezoelectric buzzer 108 via the infrared transmission portion 112 and the infrared transmission portion 158. The notification signal causes the piezoelectric buzzer 108 to ring, thereby indicating the user that all data has been transmitted. In this way, the user can know, from the position of the scanning printing portion 120, the final printing position of the desired text when the desired text is actually printed starting from the one end of the predetermined region.

Therefore, by selecting the non-printing mode and scanning the scanning printing portion 120 before printing, the user can know the length of inputted characters when printed.

Next, a modification of the second embodiment will be explained. In this modification, as shown in FIG. 10, a display portion 180 is provided to the scanning printing portion 120. When the user inputs a long character train, but desires to print only a portion of the inputted character train, the user selects the non-printing mode by using the non-printing mode selection switch 110, which results in a positive determination in S106. The user then starts scanning the scanning printing portion 120 as described above. As described, although one dot line's worth print data is transmitted based on output results of the rotary encoder 114 in S109, the ink-jet print head 4 does not perform printing. The display portion 180 provided to the printing device displays which print data has been transmitted. Therefore, when the display portion 180 starts displaying characters the user desires to print, the user then selects the print mode by using the non-printing mode selection switch 110 so that S106 results in a negative determination. When the user continues scanning movement of the scanning printing portion 120, then as described above, in S107, one dot line's worth print data is transmitted based on output results of the rotary encoder 114. In this case, because the print mode has been selected, the ink-jet print head 104 prints the desired portion of the long character train.

In this way, the user can print desired portions during scanning printing by selecting the non-printing mode for unnecessary portions and the print mode for portions of the text to be printed.

While the invention has been described in detail with reference to specific embodiments thereof, it would be apparent to those skilled in the art that various changes and modifications may be made therein without departing from the spirit of the invention, the scope of which is defined by the attached claims.

For example, the modification of the first embodiment can itself be modified so that the number of the lines can be optionally set by the user. Also, both the reduction process and the division process described in the first embodiment and its modification can be used in the same printing device. Further, processes for reducing distances between characters can be performed to insure that the print data can be printed within the print region. With any of the above-described configurations, a user can avoid the need to perform several test printings to determine whether desired characters can be printed in a desired print region such as a preprinted frame.

Although the piezoelectric buzzer is used as a notification means in the second embodiment, an LED or a vibrator could be used instead.

In the second embodiment, the scanning printing portion 20 and the input portion 170 alternatively execute infrared transmission. However, electromagnetic transmission could be used instead of infrared transmission. Alternatively, the scanning printing portion 120 and the input portion 170 could be connected via a connection cord or cable. Further, the printing device could be configured so that the scanning printing portion 120 is detachably connected with the input portion 170. In this case, print data is first inputted and stored in the input portion 170. Then, while the scanning printing portion 120 and the input portion 170 are connected together, the print data stored in the input portion 170 is stored in a memory device of the scanning printing portion 120. Then, the scanning printing portion 120 is separated from the input portion 170 after print data has been stored in a memory device of the scanning printing portion 120. Also, the scanning printing portion 120 and the input portion 170 could be formed integrally.

The ROM 152 can include, instead of the character size table including a variety of character sizes, a scaleable font wherein characters to be printed are produced by magnifying or reducing the scaleable font. Further, in the second embodiment, the ink-jet print head 104 is used as a print head. However, a heat-sensitive head or an impact head can be used as well. In the second embodiment, although the printing device was manually scanned, a motor can be provided so that the device can be automatically scanned.

It should be noted that the scanning portion 120 of the second embodiment can be made with a configuration similar to the printing device 1 of the first embodiment. Further, any component or process described in the first embodiment can be applied to the device of the second embodiment, or vice versa. For example, a printing device could be configured so that after a print region is measured using the process described in the second embodiment, the printing device automatically reduces or divides the print data as described in the first embodiment so that the print data can be printed in the print region.

What is claimed is:

1. A hand-held print device comprising:

a housing body, wherein, during printing, said housing body is scanned across a recording medium;

a storage unit storing image data for an image to be printed;

a print unit printing the image on said recording medium based on the image data stored in the storage unit;

a print region setting unit variably setting a length of a print region within which the image is to be printed on the recording medium;

a processing unit processing the image data so that the image is printable within the print region by the print unit.

2. A hand-held print device as claimed in claim 1, wherein the processing unit performs at least two processes enabling printing the image data within the print region; and said hand-held print device further comprising a selection means selecting at least one process of the at least two processes performable by the process unit.

3. A hand-held print device as claimed in claim 2, wherein one of the processes performable by the processing unit comprises a process for reducing the image before printing, said processing unit calculating a reduction rate based on a length of said image data and said length of said print region.

4. A hand-held print device as claimed in claim 3, wherein a second one of the processes performable by the processing unit comprises a process for dividing the image into a plurality of rows before printing said image.

5. A hand-held print device as claimed in claim 2, wherein one of the processes performable by the processing unit comprises a process for dividing the image into a plurality of rows before printing said image.

6. A hand-held print device as claimed in claim 1, wherein the process unit reduces the image before printing said image so that the image is printable within the print region by the print unit.

7. A hand-held print device as claimed in claim 1, wherein the process unit divides the image into a plurality of rows before printing said image so that the image is printable within the print region by the print unit.

8. A hand-held print device as claimed in claim 1, wherein the hand-held print device comprises a scanning-type device printing images when scanned across a recording medium, the hand-held print device further comprising:

a movement detection unit for detecting scanning movement of the housing body across the recording medium;

a retrieval unit serially retrieving, in correspondence with detection of said scanning movement by the movement detection unit, the image data from the storage unit, the print unit printing the image data retrieved by the retrieval unit; and a setting unit selectively setting one of a print mode for using the print unit to print according to the image data retrieved by the retrieval unit and a non-print mode for preventing printing of the data retrieved by the print unit.

9. A hand-held print device as claimed in claim 8, further comprising a notification unit measuring said length of said print region before printing when the setting unit sets the non-print mode, wherein said notification unit notifies completion of said measuring when said retrieval of image data retrieved by the retrieval unit is completed.

10. A hand-held print device for printing images when scanned across a recording medium, the hand-held print device comprising:

a housing body, wherein, during printing, said housing body is scanned across a recording medium;

a storage unit storing image data for an image;

a print unit printing the image data stored in the storage unit;

a setting unit setting a non-print mode for preventing printing of the image data stored in the storage unit; and a notification unit which, when the setting unit sets the non-print mode, notifies completion of scanning of the housing body in a distance equal to a length of the image.

11. A hand-held print device as claimed in claim 10, further comprising:

a print region setting unit setting a length of a print region within which the image is to be printed on the recording medium;

a processing unit selectively performing at least one of a plurality of processes on the image data to enable printing the image data within the print region; and a selection unit selecting at least one of the processes performable by the processing unit.

12. A hand-held print device as claimed in claim 11, wherein one of the processes performable by the processing unit comprises a process for reducing the image before printing said image.

13. A hand-held print device as claimed in claim 11, wherein one of the processes performable by the processing unit comprises a process for dividing the image into a plurality of rows before printing said image.

14. A hand-held print device for printing images when scanned across a recording medium, the print device comprising:

a housing body scanned across the recording medium during printing;

an input unit for inputting image data for an image;

a movement detection unit for detecting movement of the housing body across the recording medium;

a retrieval unit for serially retrieving, in correspondence with detection of movement by the movement detection unit, the image data inputted by the input unit;

a print unit for serially receiving the image data retrieved by the retrieval unit and printing the image data, the print unit being provided to the housing body; p1 A setting unit for selectively setting one of a print mode for using the print unit to print according to the image data retrieved by the retrieval unit and a non-print mode for preventing the print unit from printing the image data even while the print unit receives the image data from the retrieval unit.

15. A hand-held print device as claimed in claim 14, further comprising a notification unit measuring a length of a print region before printing when the setting unit sets the non-print mode, wherein said notification unit notifies completion of said measuring when said retrieval of image data retrieved by the retrieval unit is completed.

16. A hand-held print device as claimed in claim 15, further comprising:

a print region setting unit setting a length of a print region within which the image is to be printed on the recording medium;

a processing unit performing at least one of a plurality of processes on the image data to enable printing the image data within the print region; and a selection unit selecting at least one of the processes performable by the processing unit.

17. A hand-held print device as claimed in claim 16, wherein one of the processes performable by the processing unit comprises a process for reducing the image before printing said image.

18. A hand-held print device as claimed in claim 16, wherein one of the processes performable by the processing unit comprises a process for dividing the image into a plurality of rows before printing said image.

19. A hand-held print device as claimed in claim 14, further comprising:

a print region setting unit setting a length of a print region within which the image is to be printed on the recording medium;

a processing unit performing at least one of a plurality of processes on the image data to enable printing the image data within the print region; and a selection means selecting at least one of the processes performable by the processing unit.

20. A hand-held print device as claimed in claim 19, wherein one of the processes performable by the processing unit comprises a process for reducing the image before printing said image.

21. A hand-held print device as claimed in claim 19, wherein one of the processes performable by the processing unit comprises a process for dividing the image into a plurality of rows before printing said image.

22. A hand-held print device as claimed in claim 14, further comprising a display unit displaying said serially retrieved image data as said housing body is scanned across said recording medium, said display unit displaying said serially retrieved image data during said print mode and during said non-print mode.

* * * * *